US005546773A

United States Patent [19]

Lee

[11] Patent Number: 5,546,773

[45] Date of Patent: Aug. 20, 1996

[54] DOOR OPENING/CLOSING APPARATUS FOR A WASHING MACHINE

[75] Inventor: Keun-Byung Lee, Suwon, Rep. of Korea

[73] Assignee: Samsung Electronics Co., Ltd., Suwon, Rep. of Korea

[21] Appl. No.: 309,068

[22] Filed: Sep. 20, 1994

[30] Foreign Application Priority Data

Sep. 21, 1993 [KR] Rep. of Korea ..... 93-19062

[51] Int. Cl.[6] ..... D06F 39/14

[52] U.S. Cl. ..... 68/196; 49/334; 49/340; 160/188; 160/210; 292/338; 292/DIG. 69

[58] Field of Search ..... 68/12.26, 139, 68/196; 134/57 DL, 58 DL; 160/188, 192, 210, 213; 292/338, DIG. 19, DIG. 69; 49/324, 334, 338, 340, 386

[56] References Cited

U.S. PATENT DOCUMENTS

| | | | |
|---|---|---|---|
| 2,468,584 | 4/1949 | Wotring | 292/DIG. 69 |
| 2,575,704 | 11/1951 | Clark | 134/58 DL |
| 2,618,282 | 11/1952 | Stanitz et al. | 68/12.26 X |
| 2,657,475 | 11/1953 | Erickson | 68/139 X |
| 2,689,576 | 9/1954 | Colstad | 134/58 DL |
| 2,713,345 | 7/1955 | Stanitz et al. | 134/58 DL |
| 2,910,317 | 10/1959 | Conlee | 68/12.26 X |
| 4,932,707 | 6/1990 | Ekstran | 292/DIG. 69 |

FOREIGN PATENT DOCUMENTS

| | | | |
|---|---|---|---|
| 125298 | 5/1988 | Japan | 68/196 |
| 170001 | 1/1960 | Sweden | 160/210 |

*Primary Examiner*—Philip R. Coe

*Attorney, Agent, or Firm*—Burns, Doane, Swecker & Mathis L.L.P.

[57] ABSTRACT

A washing machine has a door mounted for rotation between open and closed positions. An electrical solenoid is connected to the door by means of a wire so that when the wire is pulled by the solenoid, the door is opened from a closed position, or closed from an open position. A torsion spring is connected to the door for storing energy while the door is being opened or closed, and then releasing the stored energy to maintain the door in the open or closed position. The wire is flexible to enable the door to be manually opened without actuating the solenoid.

17 Claims, 6 Drawing Sheets

DOOR OPENING/CLOSING APPARATUS FOR A WASHING MACHINE

BACKGROUND OF THE INVENTION

1. Field of the Invention

The present invention relates to a door opening/closing apparatus for a washing machine (hereinafter referred to as a "washer"), and more particularly to a door opening/closing apparatus of a washer for automatically opening and/or closing of a door on the washer by a solenoid and a torsion spring, or alternatively could be manually performed.

2. Description of the Prior Art

A conventional washer comprises a body and an upper cover.

The body is composed of a washing tub into which laundry, washing water and the like are inserted, an agitator for agitating the laundry, washing water and the like in the washing tub, a driving unit for driving (rotating) the washing tub and the agitator according to a user's selection to thereby perform the washing operation, and an exterior case for supporting or encompassing the washing tub, agitator and the like to thereby form an exterior of the washer.

The upper cover carries switches for being disposed at an upper area of the body and operated by the user, a control unit for controlling operation of the washer according to works of the switches, a door through which the laundry can be inserted into or discharged out of the washing tub, and a hot/cold water pipe for supplying the washing water into the washing tub.

FIG. 8 is a partial perspective view for illustrating a door structure in the conventional washer described above.

According to FIG. 8, a body 100 of the washer encompasses a washing tub 110 and has an upper cover 200 disposed thereon.

The upper cover 200 has a door 10.

The door 10 is formed with a folding unit 12 for enabling the door to fold and is also formed with a handle 14 on the front thereof (at the left side on the diagram).

FIGS. 9 and 10 are schematic diagrams for illustrating operational states of the door opening/closing apparatus in the conventional washer wherein FIG. 9 is a schematic diagram for illustrating a closed state of the door and FIG. 10 is a schematic diagram for illustrating an open state of the door.

According to FIG. 9, a rib 40 integrally formed with the upper cover 200 carries a hinge 20 about which the door 10 is rotatable.

The rib 40 is connected to one end of a torsion spring 50, and a lever 30 integrally formed with the door 20 is connected to the other end of the torsion spring 50.

Therefore, when the door 10 of the washer is closed, a resilient force of the torsion spring 50 acts upon the lever 30 to thereby maintain the door 10 closed.

Then, when the user holds and pushes backward a handle 14 formed at the front of the door, the door 10 is folded and opened by the operation of a folding unit 12.

When the door 10 is opened, the lever 30 is rotated around the hinge 20, and the torsion spring 50 is temporarily compressed to thereby be rotated along with the lever 30.

When the lever 30 is rotated to some extent, the direction in which the resilient force of the torsion spring 50 faces becomes the same as that of the rotating lever 30.

Accordingly, as illustrated in FIG. 10, the resilient force of the torsion spring 50 acts upon the lever 30, thereby maintaining an open state of the door 10.

As described above, when the handle 14 is pulled down to shut the door 10 under the state of the door 10 being completely open, the door 10 is unfolded.

The lever 30 is rotated around the hinge 20 when the door 10 is closed, and the torsion spring 50 is temporarily compressed to thereby be rotated along the lever 30.

When the lever 30 is rotated to some degree, the direction in which the resilient force of the torsion spring 50 acts becomes the same as that of the lever 30 that rotates.

Accordingly, as illustrated in FIG. 9, the resilient force of the torsion spring 50 acts upon the lever 30, thereby maintaining the door closed.

As mentioned above, the door opening/closing apparatus of the conventional washer enables easy opening/closing operation of the door 10 by way of the resilient force of the torsion spring 50 and enables maintainance of the closed and open states of the door 10 as well.

The apparatus of the conventional washer however has a problem in that the door has to be closed or opened manually, thereby causing inconvenience to the user.

SUMMARY OF THE INVENTION

The present invention has been provided to overcome the aforementioned problem, and it is an object of the present invention to provide a door opening/closing apparatus of a washing machine by way of automatic and manual ways, the apparatus comprising: a door driving means for operating when the electric power is applied, for opening the door upto a first point when the door is closed, and for closing the door upto a second point when the door is open; and a resilient means for being compressed by openness of the door when the door is opened and for being expanded at the first point to thereby add force to a direction to which the door is opened, and for being compressed by closedness of the door when the door is closed and for being expanded at the second point to thereby add force to a direction to which the door is closed.

BRIEF DESCRIPTION OF THE DRAWINGS

For fuller understanding of the nature and objects of the invention, reference should be made to the following detailed description taken in conjunction with the accompanying diagram in which:

FIGS. 1 and 2 are side sectional views for illustrating the structure of a door opening/closing apparatus for a washing machine according to the present invention, wherein FIG. 1 shows the door fully closed, and FIG. 2 shows the door fully open;

FIGS. 4, 5, 6 and 7 are schematic diagrams for illustrating the movement of the door, wherein FIGS. 4 and 5 are schematic diagrams for illustrating the door-opening process and FIGS. 6 and 7 are schematic diagrams for illustrating the door-closing process;

FIGS. 9 and 10 are schematic side sectional diagrams for illustrating operation states of a door opening/closing apparatus in the conventional washing machine of FIG. 8, wherein FIG. 9 depicts the door closed, and FIG. 10 shows the door open.

DETAILED DESCRIPTION OF A PREFERRED EMBODIMENT OF THE INVENTION

A detailed description of the present invention will be described in detail with reference to the accompanying diagrams.

Figure 1:
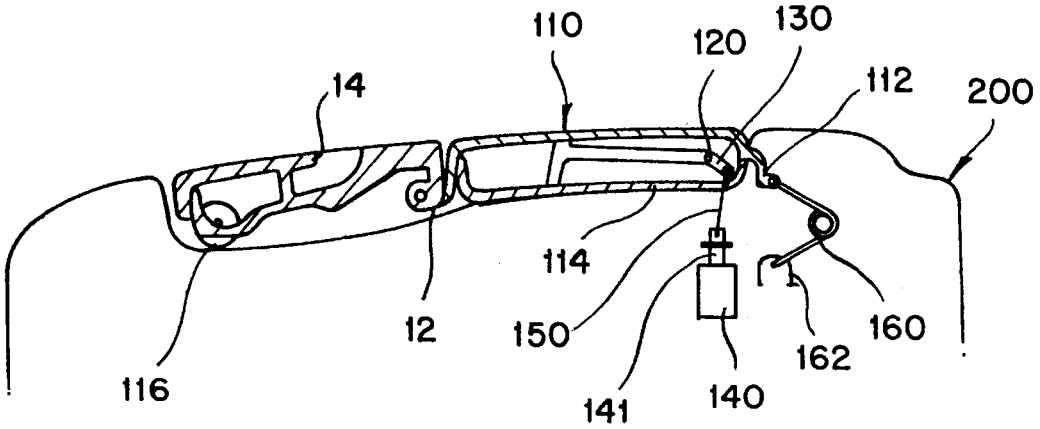

According to FIG. 1, an upper cover 200 of a washer is disposed in such a way that a door 110 can be rotated around a hinge 120.

A support 162 integrally formed with the upper cover 200 has one end of the a torsion spring 160 rotatably connected thereto, and a first lever 112 integrally formed with the door 110 has the other end of the torsion spring rotatably connected thereto.

A wire 150 is connected to a longitudinal end of a second lever 130, and the wire 150 extends through an opening 114 and is connected to an operational rod 141 of a solenoid 140 as a driving source. In the solenoid, as is conventionally known, when the power is applied, the operational rod 141 moves backward (downward in the diagram), and when the electric power is cut off, the operational rod 141 moves forward (upward in the diagram).

Meanwhile, the door 110 is formed with a folding hinge unit 12, so that the door can be folded.

A handle 14 is formed on the door at a front thereof (left side on the diagram) and a roller 116 is formed on the door at a lower front thereof.

Accordingly, as illustrated in FIG. 1, in case the door 110 of the washer is closed, the resilient force of the torsion spring 160 acts on the first lever 112, thereby maintaining the closed state of the door 110.

When the user wants to open the door 110, the user presses an open/close switch (not shown), whereupon the solenoid 140 starts to operate.

When the solenoid 140 starts to operate, the operational rod 141 moves backward to thereby pull in the wire 150, and accordingly, the second lever 130 is rotated around the hinge 120.

When the second lever 130 rotates, the door 110 is opened, and when the door 110 is opened, the first lever 112 is also rotated around the hinge 120.

When the first lever 112 rotates, the torsion spring 160 is temporarily compressed to thereby rotate along with the first lever 112.

When the first lever 112 rotates to some degree, the direction in which the resilient force of the torsion spring 160 reacts becomes the same as that of the rotating first lever 112.

At this time, the driving force of the solenoid 140 remains in force until the direction in which the resilient force of the torsion spring 160 reacts becomes the same as that of the rotating first lever 112, and the solenoid 140 is thereafter inactivated inactive, so that the operational rod 141 is moved forward.

Figure 2:
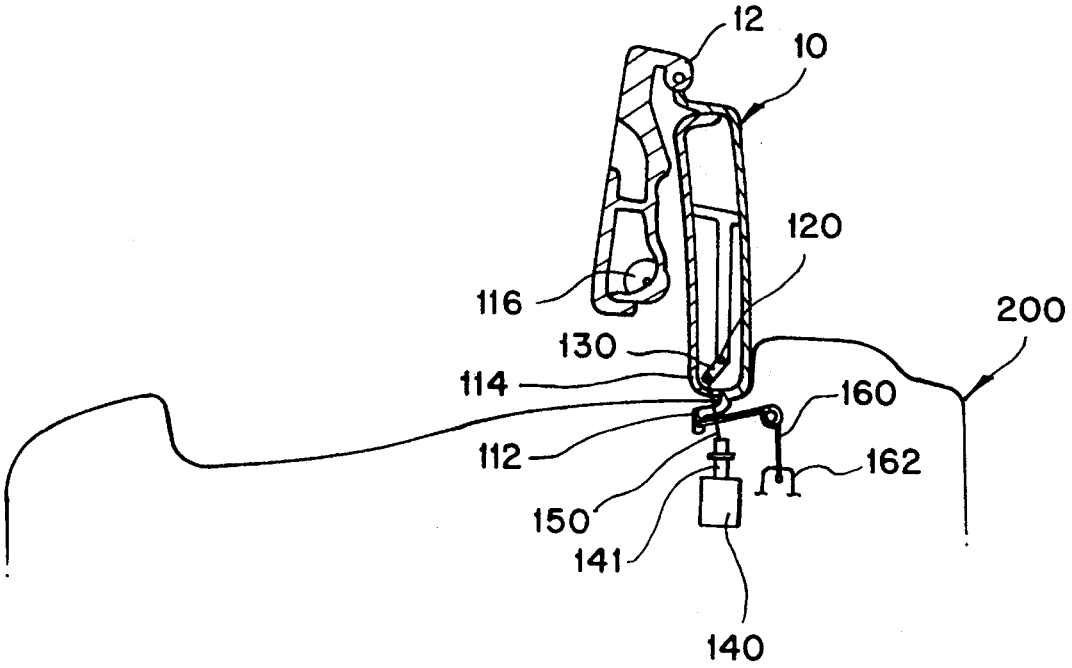

Then, as illustrated in FIG. 2, the torsion spring 160 elongates to in part its resilient force upon the first lever 112, and to cause the door 110 to completely open.

As illustrated in FIG. 2, the resilient force of the torsion spring 160 keeps acting on the first lever 112, so that the door 110 can maintain the openness thereof.

As illustrated in FIG. 2, when the user wants to close the door 110, the user presses the open/close switch (not shown), whereupon, the solenoid 140 starts to operate.

When the solenoid 140 operates, the operational rod 141 moves backward to thereby pull in the wire 150, and the second lever 130 is in turn rotated around the hinge 120.

When the second lever 130 is rotated, the door 110 is in turn closed, and when the door 110 is closed, the first lever 112 is also rotated around the hinge 120.

When the first lever 112 rotates, the torsion spring 160 is temporarily compressed to thereby rotate along with the first lever 112.

At this time, the driving force of the solenoid 140 remains in force until the direction in which the resilient force of the torsion spring 160 reacts becomes the same as the direction in which the first lever 112 rotates, and the solenoid 140 is thereafter rendered inactive and causes the operational rod 141 to advance.

Then, as illustrated in FIG. 1, the torsion spring 160 is extended to apply the resilient force thereof to the first lever 112 and to completely close the door 110.

As illustrated in FIG. 1, the resilient force of the torsion spring 160 keeps being applied to the first lever 112, thereby maintaining the closed state of the door 110.

The roller 116 disposed at a lower tip end of the door 110 helps the door to open and to close smoothly.

Figure 3:
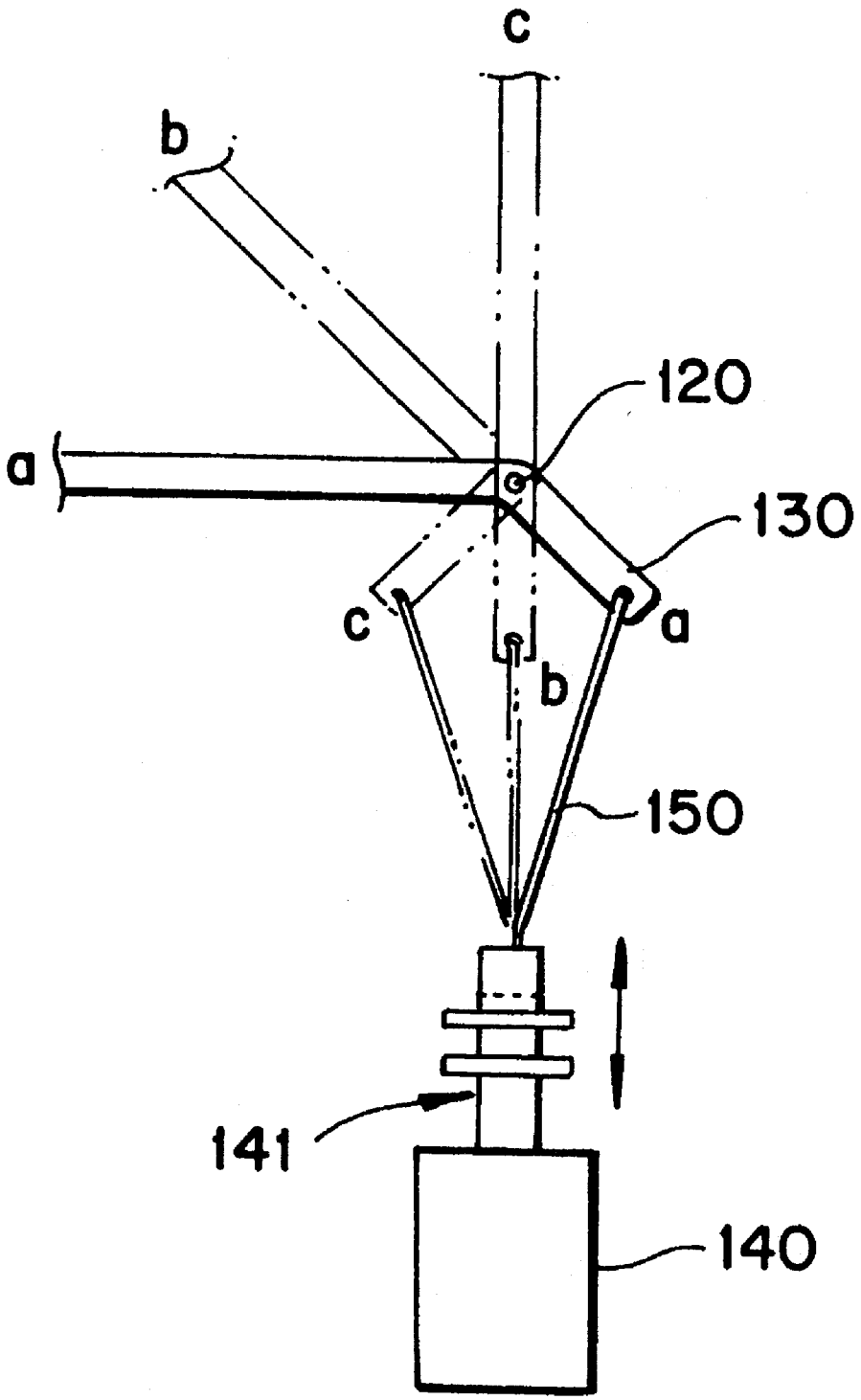
FIG. 3 is a schematic diagram for illustrating operational principles of the solenoid and the door according to the present invention.

FIG. 3 is a schematic diagram for illustrating operational principles of the solenoid 140 and the door 110 according to the present invention.

According to FIG. 3, when the door 110 of the washer is closed, the second lever 130 is placed at an "a—a" position, and the electric power is temporarily supplied to the solenoid 140 at an initial operation thereof and is cut off immediately afterwards.

At this time, when the solenoid 140 is rendered operative to thereby pull in the operational rod 141 (downwards on the diagram), the second lever 130 comes to be placed at a "b—b" position, but continues to move due to the inertial force from an intrinsic weight of the door 110.

Accordingly, the second lever 130 passes over the "b—b" position, and this is the time when the direction in which the resilient force of the torsion spring 160 reacts and the direction in which the second lever 130 is rotated become identical. The spring 160 then moves the second lever 130 to the "c—c" position.

As mentioned above, when the door 110 of the washer is to be closed, the second lever 130 is situated in the "c—c" position, and is moved over to the "b —b" position due to activation of the solenoid 140 and the inertial force from the intrinsic weight of the door 110.

At this time, the direction in which the resilient force of the torsion spring 160 reacts and the direction in which the second lever 130 is traveling become identical.

Figure 4:
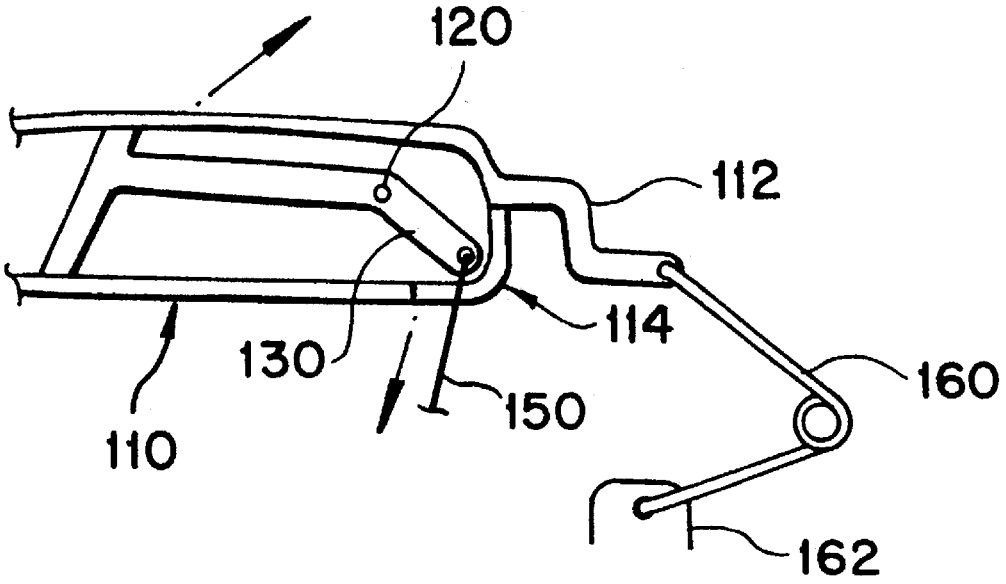
Figure 5:
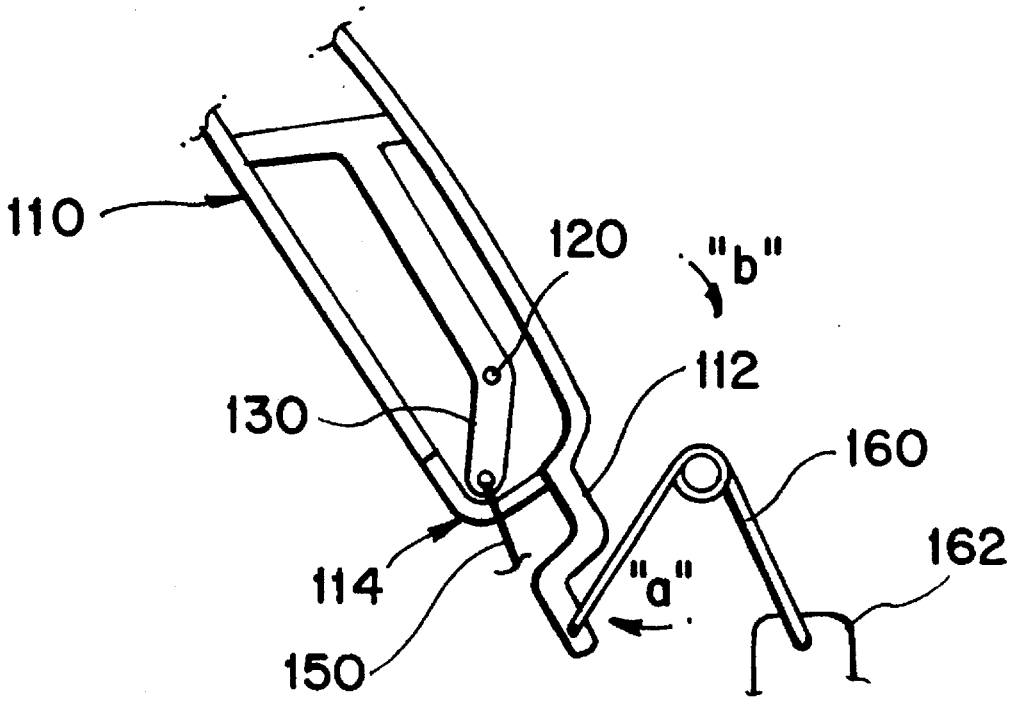
Figure 6:
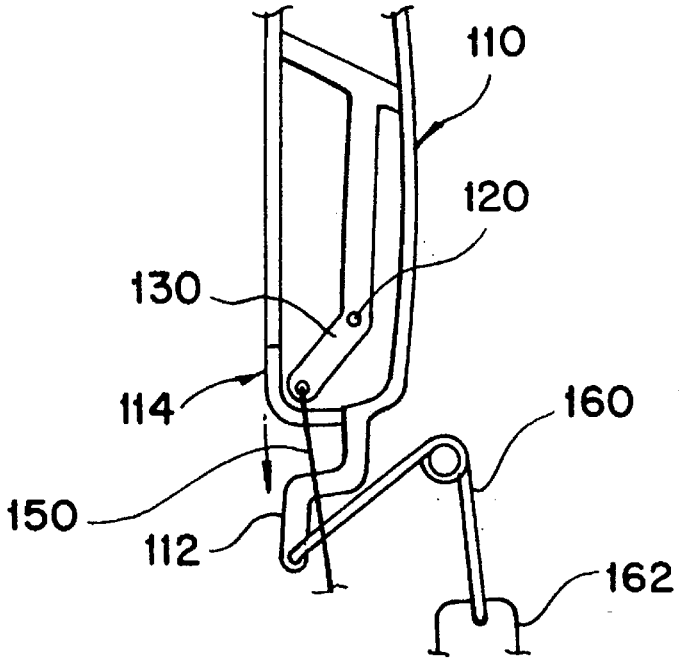
Figure 7:
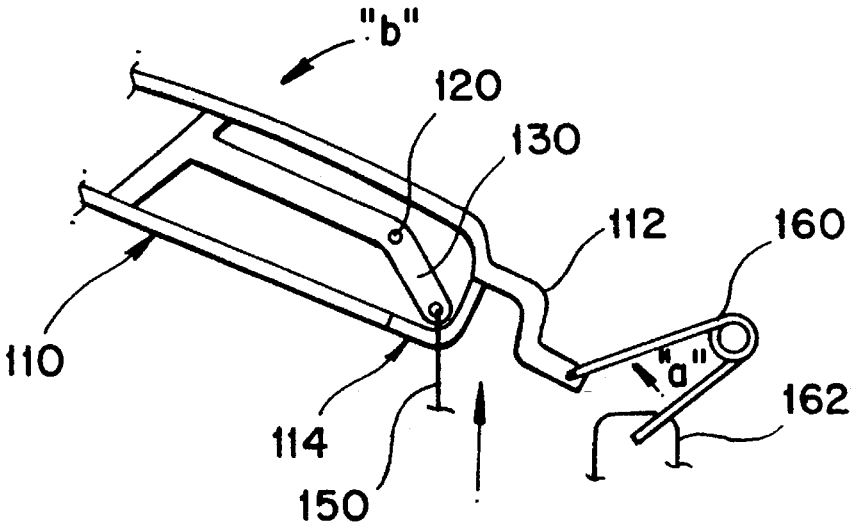
Figure 8:
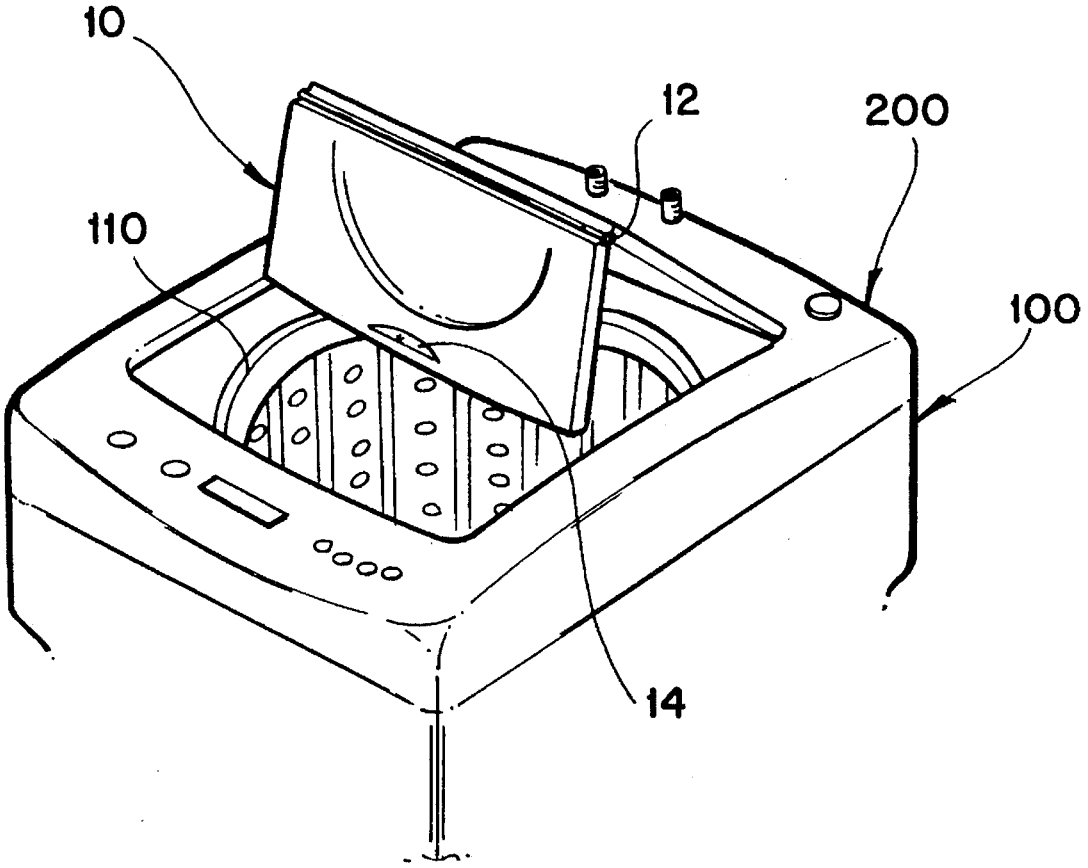
FIG. 8 (PRIOR ART)
FIG. 8 is a partial top perspective view for illustrating a door structure of a conventional washing machine.
Figure 9:
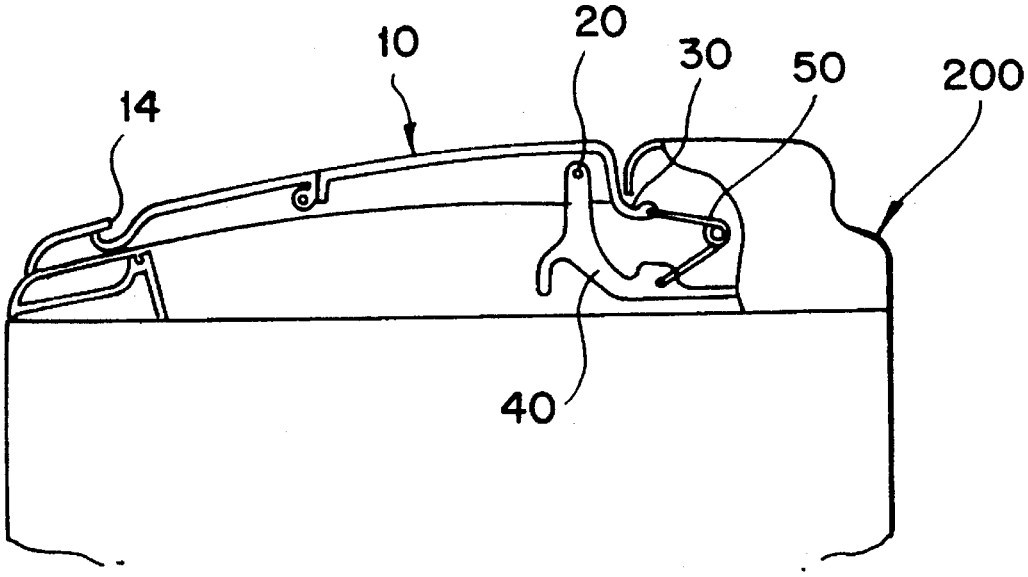
FIG. 9 (PRIOR ART)
Figure 10:
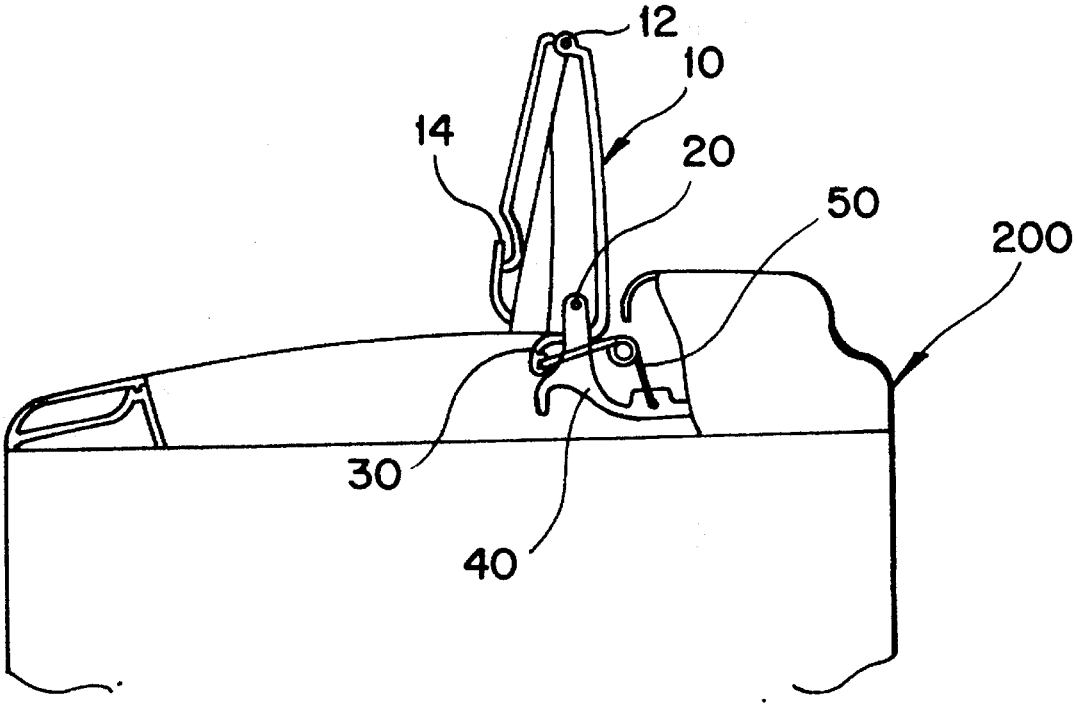
FIG. 10 (PRIOR ART)

FIGS. 4, 5, 6 and 7 are schematic diagrams for illustrating operational states of the door opening/closing apparatus according to the present invention, wherein FIGS. 4 and 5 are schematic diagrams for illustrating door-opening processes and FIGS. 6 and 7 are schematic diagrams for illustrating door-closing processes;

In FIG. 4, when the solenoid is activated to thereby pull in the wire in a downward direction, the second lever 130 is rotated around the hinge 120 (clockwise in the diagram).

At the same time, the door 110 and the first lever 112 are also rotated around the hinge 120, and the torsion spring 160 is temporarily compressed to thereby be rotated along with the first lever 112.

At this time, as described above, the second lever 130 passes over the position of "b—b" in FIG. 3, at which time, the state is the same as in FIG. 5.

The resilient force of the torsion spring 160 reacts in the arrow ("a") direction in FIG. 5, and the first lever 112 is rotated clockwise (an arrow "b" direction) around the hinge 120.

At this time, the solenoid is deactivated and the wire 150 is drawn upwardly.

The door 110 is now completely opened by the abovementioned process, as illustrated in FIG. 6.

As illustrated in FIG. 6, in a state of the door 110 being completely opened, the resilient force of the torsion spring 160 keeps biasing the first lever 112, thereby maintaining the open state of the door 110.

When the solenoid in FIG. 6 is rendered active, the wire 150 is drawn downwardly, and the second lever 130 is rotated counterclockwise around the hinge 120.

At the same time, the door 110 and the first lever 112 are in turn rotated around the hinge 120, and the torsion spring 160 is temporarily compressed to thereby be rotated along with the first lever 112.

At this time, as described above, the second lever 130 passes over the position of "b—b" in FIG. 3, at which time, the state is the same as in FIG. 7.

The resilient force of the torsion spring 160 in FIG. 7 acts in the arrow "a" direction, while the first lever 112 is rotated counterclockwise (arrow "b" direction) around the hinge 120.

At this time, the solenoid becomes deactivated, and the spring 160 continues to rotate the door counterclockwise.

The door 110 is completely closed by the abovementioned processes, as illustrated in FIG. 4.

As illustrated in FIG. 4, the resilient force of the torsion spring 160 keeps biasing the first lever 112 thereby maintaining the closed state of the door 110.

Meanwhile, the door opening/closing apparatus according to the present invention enables a manual opening and/or closing of the door on the washer when automatic operation of the door is disabled by an electrical blackout and the like.

In other words, in FIG. 1, when the user pushes back the handle 14 in order to open the door 110, the door 110 is folded about the folding unit 12.

When the door 110 is opened, the first lever 112 is rotated around the hinge 120 to thereby compress the torsion spring 160 for a moment, and the first lever 112 is in turn rotated.

When the first lever 112 is rotated to some extent, the direction in which the resilient force of the torsion spring 160 reacts is the same direction in which the first lever 112 is rotated and fully opens the door.

As illustrated in FIG. 2, the resilient force of the torsion spring 160 biases the first lever 112, thereby maintaining the open state of the door 110.

At this time, the solenoid 140 is in a deactivated state, and the wire 150 becomes loosened while the second lever 130 moves between the positions of "a—a" and "c—c" in FIG. 3.

When the user pulls the handle 14 in order to close the door 110, the door 110 is unfolded to thereby be closed about the folding unit 12.

The first lever 112 is rotated around the hinge 120 when the door 120 is being closed, and the torsion spring 160 is compressed for a moment, to thereby rotate around the first lever 112.

When the first lever 112 is rotated to some degree, the direction in which the resilient force of the torsion spring 160 acts becomes the same as the direction in which the first lever 112 is rotated to fully close the door.

Then, as illustrated in FIG. 1, the resilient force of the torsion spring 160 acts upon the first lever 112 to thereby maintain the closed state of the door 110.

As seen from the foregoing, the door opening/closing apparatus of a washing machine according to the invention enables an automatic opening and/or closing by way of the solenoid and the torsion spring, and at the same time, allows a manual operation of the door.

From the foregoing, it will be observed that numerous variations and modifications may be effected without departing from the true spirit and scope of the novel concept of this invention.

Specifically, although the above description has explained a construction where the first lever and the second lever are separate, it should be noted that the object of present invention can be obtained by forming the same as a common lever.

Furthermore, although the hinge and the support are depicted as separate, it should also be noted that these two can be integrally formed on the upper cover as in the conventional washing machine.

What is claimed is:

1. A washing machine comprising:

a container having a washing agitator;

a door mounted on said container for movement between an open position and a closed position; and a door opening/closing apparatus comprising:

a power-driven mechanism operably connected to said door for moving said door from a closed position to an open position and from an open position to a closed position, and a resilient member operably connected to said door for storing energy during movement of said door to said open and closed positions and releasing said stored energy in response to arrival of said door at said open and closed positions to maintain said door biased in said open and closed positions.

2. The washing machine according to claim 1, wherein said power-driven mechanism comprises a wire connected at one end to said door, and at another end to a power drive member for exerting a pulling force on said door through said wire to move said door to said open and closed positions.

3. The washing machine according to claim 2, wherein said wire is sufficiently flexible to enable said door to be manually opened and closed independently of actuation of said power-driven mechanism.

4. The washing machine according to claim 2, wherein said door is mounted for rotation about an axis, said one end of said wire connected to said door at a location such that a pulling force from said power drive member is disposed in non-intersecting relationship to said axis.

5. The washing machine according to claim 4, including a lever mounted to said door, said one end of said wire connected to said lever.

6. The washing machine according to claim 5, wherein said door includes upper and lower walls, said lever located in a space formed between said walls and extending through an opening in said lower wall.

7. The washing machine according to claim 4, wherein said power drive member comprises an electric solenoid.

8. The washing machine according to claim 7, wherein said resilient member comprises a compression spring that is compressed for storing energy.

9. The washing machine according to claim 8, wherein said spring comprises a torsion spring.

10. The washing machine according to claim 2, wherein said door carries support rollers arranged for rolling along said container for facilitating movement of said door between said open and closed positions.

11. The washing machine according to claim 10, wherein said door comprises first and second sections hinged together to enable said door to be folded up in said open position, said wire being connected to said first section, and said support rollers connected to said second section.

12. The washing machine according to claim 1, wherein said power-driven mechanism includes an electric solenoid.

13. The washing machine according to claim 1, wherein said resilient member comprises a compression spring that stores energy when compressed.

14. The washing machine according to claim 1, wherein said power-driven mechanism comprises a power drive member and a flexible element interconnecting said door and said power drive member.

15. The washing machine according to claim 14, wherein said flexible element is sufficiently flexible to enable said door to be manually opened independently of actuation of said power drive member.

16. The washing machine according to claim 1, wherein said door carries support rollers arranged for rolling along said container for facilitating movement of said door between said open and closed positions.

17. The washing machine according to claim 16, wherein said door comprises first and second sections hinged together to enable said door to be folded up in said open position, said power-driven mechanism connected to said first section, and said support rollers mounted on said second section.

* * * * *